US007383007B2

(12) United States Patent
Yamada et al.

(10) Patent No.: US 7,383,007 B2
(45) Date of Patent: Jun. 3, 2008

(54) FIXING DEVICE

(75) Inventors: Tetsuo Yamada, Kanagawa (JP); Atsumi Kurita, Kanagawa (JP); Toru Inoue, Kanagawa (JP); Yasuyuki Kobayashi, Kanagawa (JP); Yasushi Nagata, Kanagawa (JP); Aya Kakishima, Kanagawa (JP); Tatsunori Izawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 132 days.

(21) Appl. No.: 11/354,002

(22) Filed: Feb. 15, 2006

(65) Prior Publication Data

US 2007/0053729 A1 Mar. 8, 2007

(30) Foreign Application Priority Data

Sep. 7, 2005 (JP) ..... P2005-259202

(51) Int. Cl.
*G03G 15/20* (2006.01)

(52) U.S. Cl. ..... 399/327

(58) Field of Classification Search ..... 399/324, 399/326, 327, 328

See application file for complete search history.

(56) References Cited

U.S. PATENT DOCUMENTS 5,218,410 A * 6/1993 Nakabayashi et al. ..... 399/326
5,649,130 A * 7/1997 Nakajima et al. ..... 399/327
5,749,038 A * 5/1998 Fromm et al. ..... 399/327
5,978,640 A * 11/1999 Segawa ..... 399/327
6,002,106 A * 12/1999 Kataoka et al. ..... 399/324 X
6,438,348 B2 * 8/2002 Kobaru et al. ..... 399/324 X

FOREIGN PATENT DOCUMENTS

JP 04-291285 * 10/1992
JP A-6-110350 4/1994

* cited by examiner

*Primary Examiner*—Sandra L Brase
(74) *Attorney, Agent, or Firm*—Morgan, Lewis & Bockius LLP

(57) ABSTRACT

A fixing device for heating and pressing a recording medium carrying an unfixed toner image or an unfixed ink image to fix the unfixed toner image or the unfixed ink image on the recording medium, includes a heating roller which has a heating source and has an endless peripheral surface moves around an axis, a pressure roller which is pressed onto the peripheral surface of the heating roller, and presses the recording medium passing between the pressure roller and the heating roller onto the peripheral surface of the heating roller, and plural cleaning sections which are provided to make contact with the heating roller. At least one of the cleaning sections is set, at a portion making contact with the heating roller, to have a relatively negative potential with respect to a surface potential of the heating roller.

8 Claims, 4 Drawing Sheets

PRESENT INVENTION

COMPARISON

FIXING DEVICE

CROSS-REFERENCE TO RELATED APPLICATIONS

This application is based upon and claims the benefit of priority from the prior Japanese Patent Applications No. 2005-259202, filed on Sep. 7, 2005, the entire contents of which are incorporated herein by reference.

BACKGROUND OF THE INVENTION

1. Field of the Invention

The present invention relates to a fixing device used in an image forming apparatus such as a printer, a copier or a facsimile for heating and pressing an unfixed toner image or an unfixed ink image carried on a recording medium, to fix the image on the recording medium.

2. Description of the Related Art

In the image forming apparatus for forming a visible image with a sticking toner, a fixing device widely used for fixing the toner image on the recording medium includes a heating roller and a pressure roller. In this fixing device, the heating roller and the pressure roller are pressed to make contact each other so that the unfixed toner image is heated/pressed onto the recording medium by interposing the recording medium carrying the toner image into their contacting portion (or a nip portion). The heating roller to be mostly used in such fixing device includes a hollow core of aluminum and a heater disposed in the core, and is coated on its surface with a fluorine-containing resin or the like having an excellent releasing property.

When the recording medium carrying the unfixed toner passes through the aforementioned nip portion of the fixing device, a phenomenon that a portion of the unfixed toner on the recording medium may stick to a surface of the heating roller, that is, the offset may occur. If this toner offset occurs, the image may partially miss, or the offset toner may stick to the coming next recording medium thereby to blot the image.

Besides, the cause for the toner to offset on the heating roller has been newly found to come from the following mechanism.

A kind of the cut paper to be used as the recording medium contains calcium carbonate as the filler. When the recording medium containing the calcium carbonate is clamped and transferred by the nip portion, at which the heating roller and the pressure roller abut against each other, the calcium carbonate sticks as the paper dust to the surface layer of the heating roller. This calcium carbonate is liable to be charged in a positive polarity so that the offset of the toner is induced if the calcium carbonate sticks to the surface of the heating roller.

In most of the related arts, moreover, the heating roller is set to have a potential of the same negative polarity as that of the toner so that an electric repulsive force is generated between the heating roller and the toner charged to the negative polarity thereby to prevent the offset of the toner. If, therefore, the paper containing the calcium carbonate is used as the recording medium, the paper dust of the calcium carbonate or the like charged in the positive polarity is so electrostatically attracted to the surface layer of the heating roller set to have the potential of the negative polarity that it easily sticks to the surface layer. The paper dust of the calcium carbonate or the like having stuck to the surface of the heating roller raises the surface potential of the heating roller so that the toner charged to the negative polarity is electrostatically attracted by the heating roller thereby to cause its offset.

At the nip portion where the heating roller and the pressure roller are pressed to make contact each other, on the other hand, the back of the recording medium, i.e., the surface opposed to the surface on which the toner image is carried, is directly pressed onto the peripheral surface of the pressure roller. If the recording medium is the paper containing the calcium carbonate, much paper dust of the calcium carbonate or the like having the charge of the positive polarity sticks to the back of the recording medium so that it transfers to the surface of the pressure roller when it passes through the nip portion. The paper dust having stuck to the pressure roller transfers to the heating roller abutting against the pressure roller. The paper dust of the calcium carbonate or the like raises, if much having stuck to the surface of the heating roller, the surface potential so that the unfixed toner charged in the negative polarity on the recording medium is electrostatically attracted and transferred to the heating roller thereby to cause the offset of the toner.

Although the device for fixing the toner image has been described on its problems, the printer using ink, the ink jet type image forming apparatus and the like may use a device for fixing the ink image early by inserting the recording medium between the circumferentially moving heating roller and the pressure roller to be pressed to make contact with the former, and by heating and pressing the recording medium so that the ink may be earlier fixed. This device is encountered by the offset of the ink image and by the blotting of the image, if much dust of the calcium carbonate sticks to the peripheral surface of the heating roller, which makes direct contact with the surface of the recording medium carrying the ink image.

SUMMARY OF THE INVENTION

The present invention has been made in view of the above circumferences and provides a fixing device for fixing an unfixed toner image or an unfixed ink image on a recording paper, in which it is effectively prevented from an offset phenomenon which might be induced by the sticking of paper dust of calcium carbonate or the like to a heating roller.

According to an aspect of the present invention, a fixing device for heating and pressing a recording medium carrying an unfixed toner image or an unfixed ink image to fix the unfixed toner image or the unfixed ink image on the recording medium, includes a heating roller which has a heating source and has an endless peripheral surface moves around an axis, a pressure roller which is pressed onto the peripheral surface of the heating roller, and presses the recording medium passing between the pressure roller and the heating roller onto the peripheral surface of the heating roller, and plural cleaning sections which are provided to make contact with the heating roller. At least one of the cleaning sections is set, at a portion making contact with the heating roller, to have a relatively negative potential with respect to a surface potential of the heating roller.

According to another aspect of the present invention, a fixing device for heating and pressing a recording medium carrying an unfixed toner image or an unfixed ink image to fix the unfixed toner image or the unfixed ink image on the recording medium, includes a heating roller which has a heating source and has an endless peripheral surface moves around an axis, a pressure roller which is pressed onto the peripheral surface of the heating roller, and presses the recording medium passing between the pressure roller and the heating roller onto the peripheral surface of the heating roller, and a pressure roller cleaning section which is disposed to face the pressure roller. A potential of the pressure roller cleaning section is set to be relatively negative with respect to a surface potential of the pressure roller.

According to still another aspect of the present invention, a fixing device for, fixing an unfixed toner image or an unfixed ink image on a recording medium, includes a fixing section including a pair of rollers, and plural cleaning sections provided to make contact with one of the pair of rollers of the fixing section. At least one of the cleaning sections is set, at a portion making contact with the one roller, to have a relatively negative potential with respect to a surface potential of the roller.

DETAILED DESCRIPTION

Embodiments of the invention are described in the following with reference to the accompanying drawings.

Figure 1:
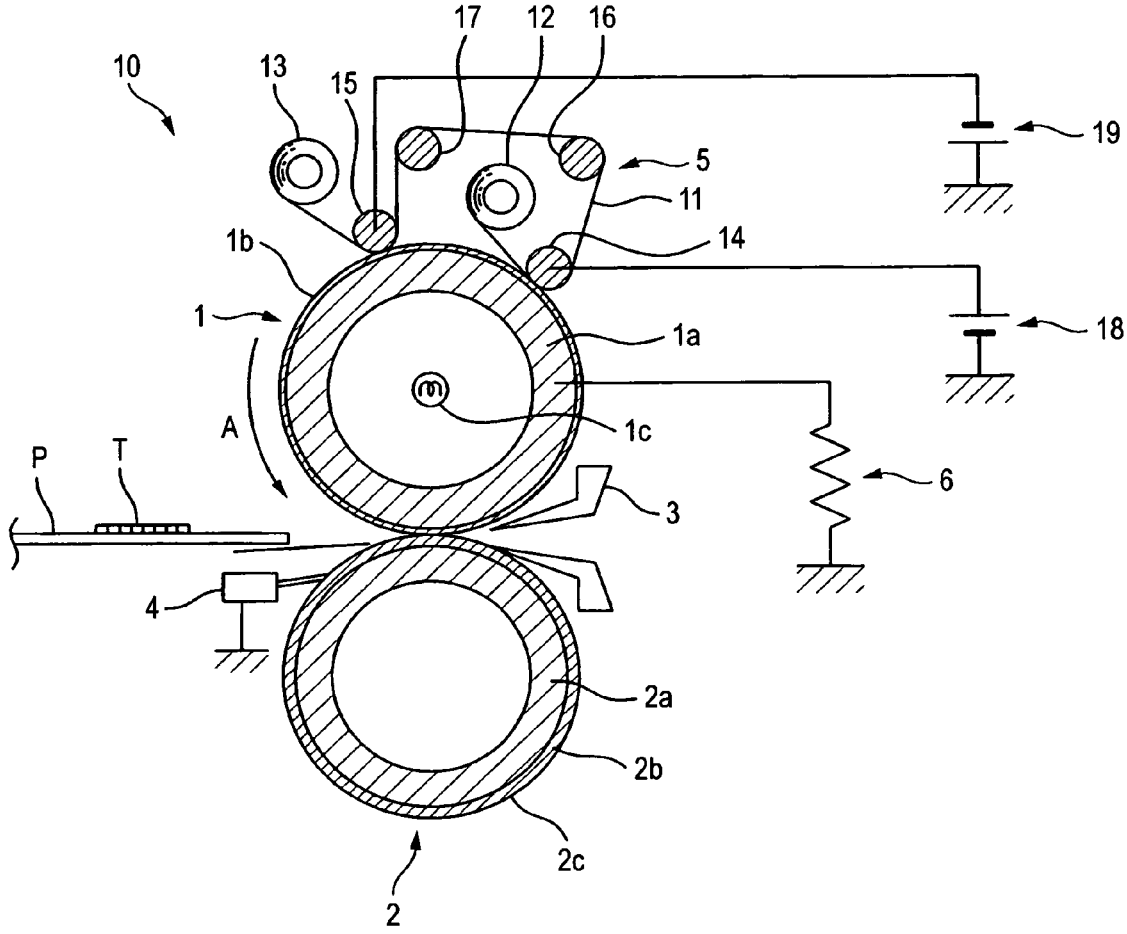
FIG. 1 is a schematic cross section showing a fixing device according to a first exemplary embodiment of the invention.

FIG. 1 is a schematic cross section showing a fixing device according to a first exemplary embodiment of the invention.

This fixing device is configured to include major units: a heating roller 1 rotatably supported on a center axis; a pressure roller 2 rotated in parallel while being pressed onto the heating roller 1; and a heating roller cleaning device 5 abutting against the peripheral surface of the heating roller 1.

The heating roller 1 is composed of a metallic cylindrical core 1*a* having a conductivity, and a surface releasing layer 1*b* laminated on the cylindrical core 1*a*, and is so supported on the body frame of an image forming apparatus by the (not-shown) flange that it is rotationally driven. A halogen heater 1*c* is arranged in the heating roller 1 to feed a heat necessary for the fixing. The cylindrical core 1*a* is electrically grounded to the earth through a high resistance 6 thereby to have a constant potential and to relax the electric field, which is established when a discharge is caused between itself and a recording medium.

Here in this embodiment, the potential of the cylindrical core 1*a* of the heating roller 1 is set by the high-resistance grounding, which can be replaced by the application of a predetermined potential from a power source.

The cylindrical core 1*a* of the heating roller 1 can be made of a metal excellent in a heat conductivity and a rigidity, such as aluminum, iron or stainless steel. In this embodiment, aluminum is used for the core to have a surface releasing layer of a thickness of 30 μm. This surface releasing layer is formed by powder-coating the peripheral surface of the core with a PTFE resin having silicon carbide powder dispersed, and then by baking it. The external diameter is 65 mm.

The pressure roller 2 is composed of: a metallic cylindrical core 2*a*; an elastic layer 2*b* of sponge or rubber formed on the surface of that core; and a releasing layer 2*c* of a fluorine-containing resin formed to cover the surface of the elastic layer 2*b*. In this embodiment, the elastic layer is made of silicone rubber having a thickness of 12 mm, and the releasing layer is formed by coating a PEA resin tube having a thickness of 30 μm, which is made conductive by dispersing carbon powder. Moreover, the pressure roller 2 is electrically grounded at its surface to the earth by bringing a conductive brush 4 into abutment against the pressure roller 2.

The heating roller cleaning device 5 is arranged at the position to face the peripheral surface of the heating roller 1. This heating roller cleaning device 5 is composed of: a long cleaning web 11; a let-off roller 12 for letting off the cleaning web 11; a take-up roller 13 for taking up the cleaning web 11; a first abutting roller 14 and a second abutting roller 15 for bringing the cleaning web 11 into two portions of the peripheral surface of the heating roller 1; and a first winding roller 16 and a second winding roller 17 for winding the cleaning web 11 to bring its surface and back into abutment against the heating roller 1. The portion, at which the first abutting roller 14 is pressed onto the heating roller 1 through the cleaning web 11, provides a first cleaning section, and the portion, at which the second abutting roller 15 is pressed onto the heating roller 1 through the cleaning web 11, provides a second cleaning section.

The cleaning web 11 is a band-shaped long member having a thickness of 50 μm and prepared by impregnating a mixed nonwoven fabric of polyimide-amide fibers and polyester fibers with silicone oil. The cleaning web 11 is wound at its one end on the let-off roller 12 and is gradually taken up at its other end by the take-up roller 13. The cleaning web 11 let off the let-off roller 12 is wound on the first abutting roller 14 and is pressed onto the peripheral surface of the heating roller 1 as the first abutting roller 14 is pressed onto the heating roller 1. When the heating roller 1 is rotationally driven in this state, the cleaning web 11 rubs the peripheral surface of the heating roller 1 thereby to clear it of paper dust or toner. On the downstream side of the wound position of the first abutting roller 14, the tensing direction of the cleaning web 11 is changed by the first winding roller 16 and the second winding roller 17 so that the cleaning web 11 is wound on the second abutting roller 15. As at the position wound on the first abutting roller 14, the cleaning web 11 is pressed onto the peripheral surface of the heating roller 1. At this time, the back of the cleaning web 11 having passed through the first winding roller 16 and the second winding roller 17, that is, the surface on the opposite side of the surface having been pressed onto the heating roller 1 by the first abutting roller 14 is pressed onto the peripheral surface of the heating roller 1. The cleaning web 11 cleans the peripheral surface of the heating roller 1 with its back and is then taken up by the take-up roller 13.

The abutting rollers 14 and 15 are made of conductive silicone rubber. A voltage of +200 V is applied to the first abutting roller 14 by a first power source is, and a voltage of −200 V is applied to the second abutting roller 15 by a second power source 19. As a result, an electric field for attracting the toner having stuck to the surface layer of the heating roller 1 and having a potential of a negative polarity toward the first abutting roller 14 is established between the first abutting roller 14 and the heating roller 1. Between the second abutting roller 15 having the voltage of −200 V applied thereto and the heating roller 1, on the other hand, an electric field is established to attract the paper dust such as calcium carbonate or the like having stuck to the surface layer of the heating roller 1 and charged to a positive polarity, electrostatically toward the second abutting roller 15.

In this embodiment, the cleaning web 11 abuts against two portions of the peripheral surface of the heating roller 1, and removes, individually at the two positions, the toner charged to the negative polarity or the paper dust of the calcium carbonate charged to the positive polarity. However, the cleaning web 11 may also set to abut at three or more positions against the heating roller 1.

In this embodiment, moreover, both the surface layer 1*b* of the heating roller 1 and the cleaning web 11 are made of the insulating materials so that no current leakage is caused between the heating roller 1 and the abutting rollers 14 and 15 thereby not to degrade the cleaning function of the heating roller 1. Here, similar effects could be obtained even if either the surface layer of the heating roller 1 or the cleaning web 11 only were made of an insulating material.

Still moreover, this embodiment uses the cleaning web 11 as the cleaning member but could use a blade member; a roll-shaped member, a rotating brush or the like to abut against the heating roller 1.

Next, the operations of the fixing device are described in the following.

The heating roller 1 is rotationally driven in the direction of arrow A, as shown in FIG. 1, and the pressure roller 2 rotates, following the heating roller 1. A recording medium P, to which an unfixed toner image is transferred, is conveyed to a nip portion, at which the heating roller 1 and the pressure roller 2 are pressed to make contact with each other. This recording medium P is moved as the heating roller 1 rotates, so that a toner image T on the recording medium is melted by the heat transfer from the heating roller 1 and fixed on the recording medium. After this, the recording medium having the toner image fixed thereto is released from the heating roller 1 or the pressure roller 2 by a releasing member 3 so that it is discharged, while being clamped by the (not-shown) discharge roller, to the outside of the device.

The core 1*a* of the heating roller 1 is grounded to the earth through the resistance, and the pressure roller 2 is also grounded to the earth by the conductive brush 4, thereby to prevent an electric field from being established between the heating roller 1 and the pressure roller 2. As a result, the toner charged to the negative polarity is prevented from being transferred to the heating roller 1 by the electric force, when the recording medium P is clamped by the nip portion between the heating roller 1 and the pressure roller 2. Moreover, the paper dust, if having stuck to the recording medium or paper and charged to the positive polarity, is prevented from being transferred to the heating roller 1 by the electric force.

However, the toner or paper dust may be transferred to the heating roller 1 by an action other than that of the electric force, when the recording medium P carrying the toner image is pressed onto the heating roller 1. This toner or paper dust is removed in the following manner from the surface of the heating roller 1.

The toner or paper dust having stuck to the surface of the heating roller 1 is transferred by the rotation of the heating roller 1 to the position which faces the first abutting roller 14. A voltage of +200 V is applied to the first abutting roller 14, so that an electric field is established between the abutting roller 14 and the heating roller 1. As a result, the toner charged to have the negative polarity is influenced in the direction from the heating roller 1 to the first abutting roller 14 so that it easily leave the surface of the heating roller 1. As a result, the toner is easily released by the rubbing action of the cleaning web 11 so that it sticks to and is removed by the cleaning web 11.

On the other hand, the paper dust charged to the positive polarity is influenced by the electrostatic force to attract it toward the heating roller 1 so that it becomes hard to leave the heating roller 1. At the abutting position against the first abutting roller 14, therefore, the paper dust is hard to be completely removed so that it is transferred through that position to the position faced by the second abutting roller 15.

The second abutting roller 15 is supplied with a voltage of −200 V thereby to establish art electric field between itself and the heating roller 1. By this electric field, the paper dust charged to the positive polarity is influenced by the electrostatic force from the heating roller 1 to the second abutting roller 15 so that it is easily released from the peripheral surface of the heating roller 1. As a result, the paper dust on the heating roller 1 is released by the rubbing action of the cleaning web 11 so that it sticks to and is removed by the cleaning web 11.

At this time, the cleaning web 11 makes contact at its surface with the heating roller 1 as is opposed to the surface on which it makes contact with the heating roller 1 at the position where it is wound on the first abutting roller 14. As a result, the toner having been transferred at the position wound on the first abutting roller 14 sticks to the outer side of the cleaning web 11 at the position wound on the second abutting roller 15 so that the toner on the cleaning web 11 is not transferred to the heating roller 1 even if the second abutting roller 15 is set to have the potential of the negative polarity.

The surface of the heating roller 1 is thus cleaned so that the toner or paper dust sticks to the cleaning web 11. As the sticking becomes more, the cleaning effect of the cleaning web 11 is degraded. However, the cleaning web 11 is driven and taken up by the take-up roller 13 from the let-off roller 12 so that the cleaning web 11 always abuts on its fresh face against the peripheral surface of the heating roller 1 thereby to keep the satisfactory cleaning effect.

On the other hand, the heating roller 1 has a surface made of the insulating layer, and the cleaning web 11 is also made of an insulating member. Therefore, the electric current does not leak between the abutting rollers 14 and 15 and the heating roller 1. As a result, the cleaning function of the cleaning web 11 is not degraded by the leakage of the electric current, but the toner and the paper dust of calcium carbonate are effectively removed from the peripheral surface of the heating roller 1 so that a satisfactory image can be fixed. In this embodiment, the heating roller 1 is provided with the insulating layer, but similar effects could be obtained even if the insulating layer were formed on the surfaces of the abutting rollers 14 and 15.

In the fixing device according to this embodiment, as has been described hereinbefore, it is possible to prevent such an offset of the toner effectively as might otherwise be induced as a result that the paper dust of calcium carbonate or the like has stuck, and to remove such a toner effectively as has been transferred to the heating roller 1. It is, therefore, possible to prevent the next image from being blotted with a missing toner image or an offset toner.

Next, an experiment for confirming the effects to prevent the offset in the aforementioned fixing device is described in the following.

Figure 2:
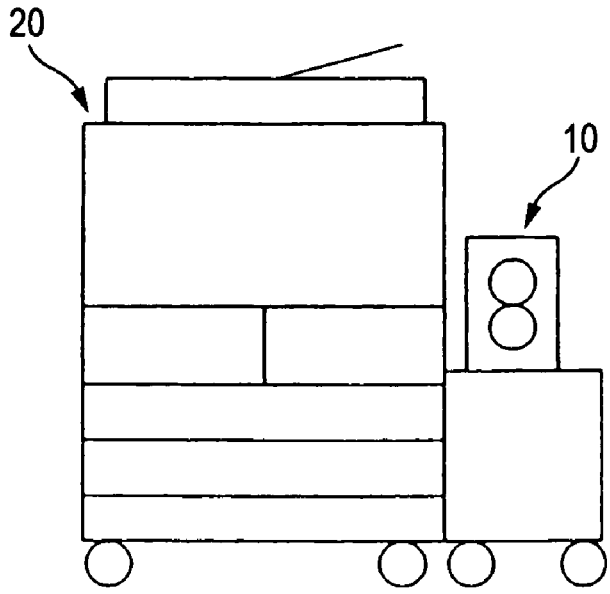
FIG. 2 is a schematic configuration diagram showing a laboratory equipment used to confirm the effects of the invention.

In this experiment, a printer DocuCentre f1100 PS made by Fuji Xerox Co., Ltd. is employed as a device 20 for separately providing a fixing device 10 with a recording medium carrying an unfixed image, and is modified to output the unfixed image. As shown in FIG. 2, the printer is arranged adjacent to the fixing device 10, as shown in FIG. 2, and the recording medium carrying the unfixed toner image is introduced into the fixing device.

In the experiment, the test images are outputted in a predetermined number of sheets and fixed by the fixing device. After this, an image for detecting offset is formed, and the occurrence of the offset is detected.

Figure 3:
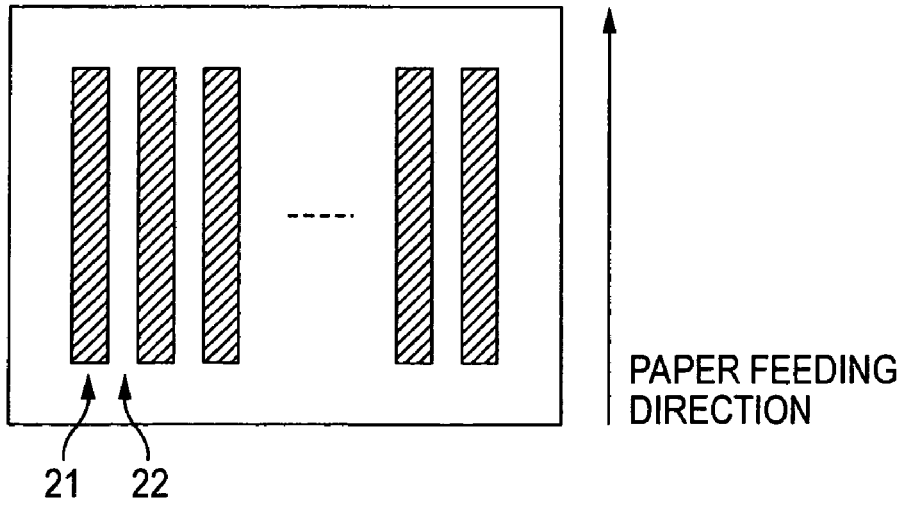
FIG. 3 is a diagram showing a test image to be used in the experiments for confirming the effects of the invention.
Figure 4A:
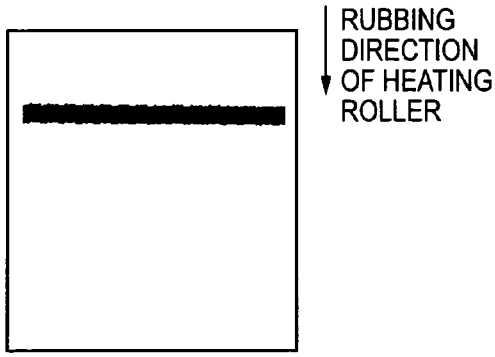
FIGS. 4A and 4B are schematic diagrams showing the distributions of an offset toner, which were detected in the experiments for forming the effects of the invention.

The test image to be fixed in the predetermined sheets is a band image of a pitch of 10 mm, as shown in FIG. 3, and its toner image is formed and transferred to recording paper (i.e., the A4 size paper having a commercial name of "Green 100" made by Fuji Xerox Co., Ltd.). 5,000 sheets of such output image are provided to the fixing device. After that, six sheets of images for detecting offset, i.e., Green 100 paper (of A3 size) carrying a full-face half tone image of an image density of 40% are provided. At this time, a sponge pad is used to apply the offset detecting paper (i.e., the paper having a commercial name of "JD coat paper" made by Fuji Xerox Co., Ltd.) to the heating roller 1 on the upstream side of the cleaning device, and the offset toner is cleaned and recovered from the peripheral surface of the heating roller 1. After this, the JD coat paper is removed from the heating roller 1, and the recovered toner on the JD coat paper is visually graded by comparing and evaluating the amounts of offset toner on the test image for the region, through which a blank portion 22 having no toner transferred has repeatedly passed, and the region, through which an image portion 21 having the toner transferred has passed. As a result, the difference in the amounts of offset toner is not confirmed, as shown in FIG. 4A.

Next, experiments like the aforementioned ones are executed by substituting insulating abutting rollers for the abutting rollers 14 and 15 of the heating roller cleaning device 5 disposed at the position to face the heating roller 1 and by feeding the abutting rollers with no voltage to keep them in an electrically floating state. As a result, it is confirmed that the amount of offset toner is more in the range 23, through which the blank portion having no image has repeatedly passed, than in a region 24, through which the image portion has repeatedly passed, as shown in FIG. 4B.

The experimental results thus presented can be thought, as follows.

When the test image shown in FIG. 3 is repeatedly fixed, the heating roller 1 is always pressed at the portion 22 having no toner image onto the recording paper, so that the paper dust of calcium carbonate or the like is liable to stick to the heating roller 1. At the portion 21 having the toner image, on the contrary, the paper dust is hard to stick. In addition, even if the paper dust is caused to stick to the heating roller 1 by fixing the toner image, it sticks to the toner image so that it is removed when the toner image is fixed. When the offset detecting image is fixed after the test images were repeatedly fixed, the offset state is not changed, as shown in FIG. 4A, between the position of the test image, which has been kept in abutment against with the blank portion, and the portion, from which the paper dust has been removed by the toner image. This unchanged state is estimated to come from the fact that the paper dust has been effectively removed by the heating roller cleaning device 5.

Figure 4B:
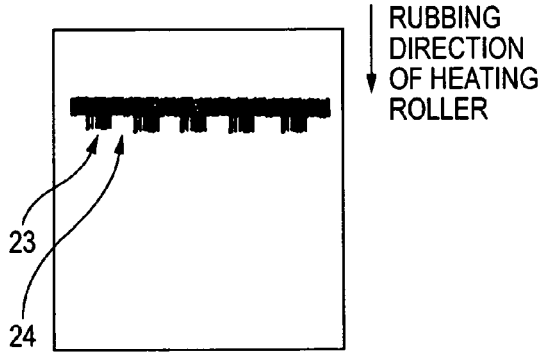

When the position of the test image, which has been continuously abutting against the blank portion 22, has a prominent offset, as shown in FIG. 4B, it can be estimated that the paper dust has not been effectively removed by the heating roller cleaning device 5 so that the offset has been induced by the paper dust having stuck to the heating roller 1.

By removing the paper dust having stuck to the heating roller 1, electrostatically, as described above, it is possible to prevent such an offset of the toner effectively as might otherwise be induced by the paper dust having stuck to the peripheral surface of the heating roller 1.

Another exemplary embodiment of the invention is described in the following.

Figure 5:
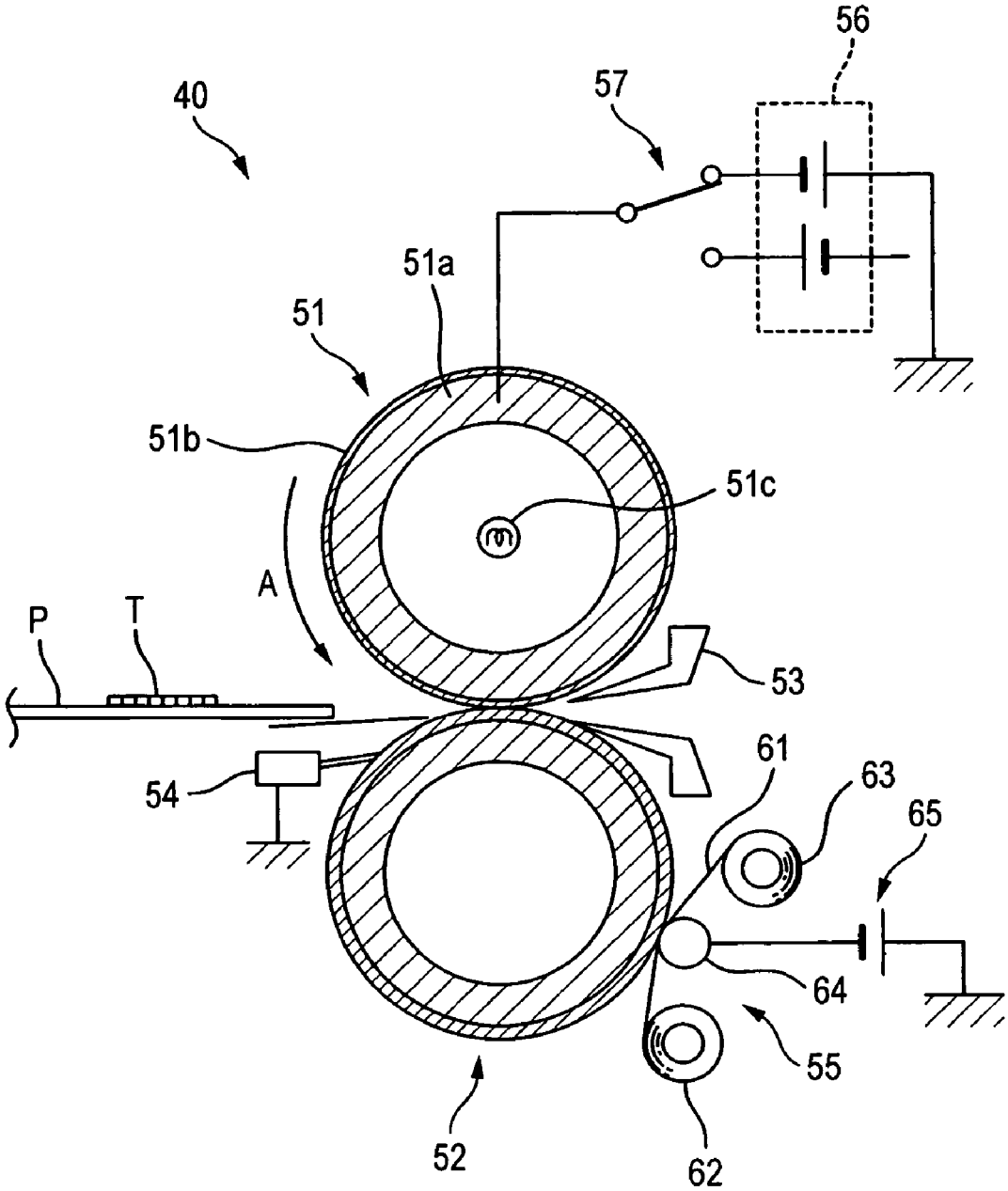
FIG. 5 is a schematic cross section showing a fixing device according to a second exemplary embodiment of the invention.

FIG. 5 is a schematic cross section showing a fixing device of the embodiment of the invention.

This fixing device 40 is configured to include major units: a heating roller 51 rotatably supported on a center axis; a pressure roller 52 rotated in parallel while being pressed onto the heating roller 51; a power source 56 for applying a voltage to the heating roller 51; a switch 57 for switching the potential of the heating roller 51; and a pressure roller cleaning device 55 abutting against the peripheral surface of the pressure roller 52.

The heating roller 51, the pressure roller 52, a releasing member 53 and a conductive brush 54 used are identical to those of the fixing device shown in FIG. 1.

A halogen heater 51*c* is arranged in the heating roller 51 for feeding a heat necessary for the fixing operation. A core 51*a* of the heating roller 51 is fed with a voltage from the power source 56, which is provided with the switch 57 for switching the potential. In other words, the power source 56 has a function to set the heating roller 51 at a potential of a positive polarity with respect to the pressure roller 52, and a function to set the same at a potential of a negative polarity. The switch 57 switches the aforementioned potential when the recording medium is interposed between the heating roller 51 and the pressure roller 52 or not.

The pressure roller cleaning device 55 is composed of: a long cleaning web 61; a let-off roller 62 for winding the cleaning web 61 in a roll shape and for letting off the cleaning web 61; a take-up roller 63 for taking up the cleaning web 61; and an abutting roller 64 for bringing the cleaning web 61 into abutment against the peripheral surface 51*b* of the heating roller 51.

The cleaning web 61, the let-off roller 62, the take-up roller 63 and the abutting roller 64 employed are identical to those of the fixing device shown in FIG. 1. In this cleaning device 55, however, no winding roller is used, but only one abutting roller is used so that the cleaning web 61 is pressed at one portion onto the pressure roller 52. The abutting roller 64 is supplied with a voltage of −200 V from the power source 65 to establish an electric field between the abutting roller 64 and the pressure roller 52 thereby to generate an electric force to attract the paper dust of calcium carbonate or the like charged with a positive polarity, to the side of the cleaning web 61.

The take-up roller 63 is rotationally driven by the (not-shown) drive device so that the cleaning web 61 is let off the let-off roller 62 and is slowly taken up.

In this embodiment, the cleaning web 61 of the pressure roller cleaning device 55 abuts at one portion against the peripheral surface of the pressure roller 52, but may abut at plural portions. As in the fixing device shown in FIG. 1, the cleaning web 61 may also be made to run on the winding roller so that it can be used on its two faces.

The fixing device 40 operates, as follows.

The heating roller 51 is rotationally driven in the direction of arrow A, as shown in FIG. 5, and the pressure roller 52 rotates, following the heating roller 51. The recording medium P, to which an unfixed toner image has been transferred, is transferred to the nip portion, at which the heating roller 51 and the pressure roller 52 are pressed to make contact with each other. This recording medium P is moved as the heating roller 51 rotates, so that the toner image on the recording medium is melted by the heat transferred from the heating roller 51 and is fixed on the recording medium. After this, the recording medium having the toner image fixed thereon is released from the heating roller 51 or the pressure roller 52 by the releasing member 53 so that it is discharged, while being clamped by the (not-shown) discharge roller, to the outside of the device.

When the recording medium P is clamped at the nip portion between the heating roller 51 and the pressure roller 52, as described above, the switch 57 is set to apply the negative voltage to the core 51*a* of the heating roller 51 from the power source 56. As a result, the heating roller 51 is set at the relatively negative potential with respect to the pressure roller 52 so that an electric field is established between them. The unfixed toner T on the recording medium P charged to the negative polarity is influenced by the force to attract it in the electric field to the side of the recording medium so that the toner is prevented from being transferred to the heating roller 51. This prevents the toner from being offset to the heating roller 51.

On the other hand, the paper dust of calcium carbonate or the like having the positive polarity is attracted by and transferred to the heating roller 51 having the relatively negative potential. Moreover, the paper dust having stuck to the back side of the recording medium is transferred by the non-electric action to the pressure roller 52 making direct contact with the paper dust.

After the recording medium P passed through the nip portion, that is, when the recording medium P is not interposed into the nip portion, the switch 57 is switched to set the heating roller 51 to the positive polarity with respect to the pressure roller 52. As a result, the paper dust having stuck to the surface of the heating roller 51 has a positive polarity so that it transfers to the pressure roller 52 having the potential of a negative polarity.

The pressure roller cleaning device 55, which is disposed to face the pressure roller 52, presses the cleaning web 61 onto the peripheral surface of the pressure roller 52 so that it is rubbed on its peripheral surface by the rotation of the pressure roller 52. At this time, the abutting roller 64 for pressing the back side of the cleaning web 61 is supplied with a voltage of −200 V. As a result, an electric field is established between the pressure roller 52 electrically grounded to the earth by the conductive brush 54 and the abutting roller 64, so that the paper dust having the charge of a positive polarity is influenced by the force to attract it to the side of the abutting roller 64. By this electric force, the paper dust is easily released from the pressure roller 52 so that it is easily removed by the rubbing action of the cleaning web 61. The paper dust thus transferred directly from the recording section to the pressure roller 52 and the paper dust transferred to the pressure roller 52 after having stuck to the heating roller 51 are cleaned by the heating roller cleaning device 55 so that the paper dust having the positive polarity is prevented from depositing on the surface of the heating roller 51.

Moreover, the cleaning web 61 abutting against the peripheral surface of the pressure roller 52 is made of an insulating member, so that an electric current does not leak between the abutting roller 64 and the pressure roller 52 even if a voltage is applied inbetween. As a result, the proper electric field is kept between those members so that the paper dust of the calcium carbonate or the like can be efficiently removed from the peripheral surface of the pressure roller 52 without lowering the cleaning function of the cleaning web 61.

In this embodiment, the cleaning web 61 is made to have the insulating property, but similar effects could be obtained even if the pressure roller 52 had an insulating layer near its surface.

In this embodiment, moreover, the pressure roller cleaning device 55 is exemplified by rubbing the cleaning web 61, but it can be replaced by a cleaning device having a blade member, a rolled member or a rotary brush to abut against the pressure roller 52.

The fixing device 40 was subjected to experiments similar to those of the fixing device shown in FIG. 1. The offset states, which might otherwise occur after the feed of 5,000 sheets of the test image shown in FIG. 3, were found not different between the range 22, through which the blank portion of the test image had repeatedly passed, and the range 21, through which the black portion of the toner image had repeatedly passed.

For comparisons, similar experiments were conducted without using the pressure roller cleaning device 55. More offsets occurred more in the range 23, through which the blank portion 22 of the test image had repeatedly passed, than in the range 24, through which the black portion 21 of the toner image had repeatedly passed.

From the results thus far described, it is estimated from the comparisons that the paper dust of the calcium carbonate or the like was transferred from the recording medium to the heating roller 51 and the pressure roller 52 in the range 23, through which the blank portion 22 had repeatedly passed, and that the offset of the toner was caused by that transfer. In the fixing device of the embodiment of the invention, as shown in FIG. 5, it is also found that no increase in the offset was found even in the state where the paper dust was liable to transfer to the heating roller 51, and that the offset, which might otherwise be induced by the sticking of the paper dust, was effectively prevented.

The embodiments thus far described are wholly directed to the devices for fixing the toner image formed by the sticking of powdery toner. In addition, the ink image, which is formed by a printer or an image forming apparatus of an ink jet type, may be heated and pressed to be prematurely fixed. In this fixing device, too, it is thought that troubles are caused by the sticking of the paper dust of the calcium carbonate or the like. The invention can also be applied to such fixing device.

As described so far, according to an aspect of the present invention, a fixing device for heating and pressing a recording medium carrying an unfixed toner image or an unfixed ink image to fix the unfixed toner image or the unfixed ink image on the recording medium, includes a heating roller which has a heating source and has an endless peripheral surface moves around an axis, a pressure roller which is pressed onto the peripheral surface of the heating roller, and presses the recording medium passing between the pressure roller and the heating roller onto the peripheral surface of the heating roller, and plural cleaning sections which are provided to make contact with the heating roller. At least one of the cleaning sections is set, at a portion making contact with the heating roller, to have a relatively negative potential with respect to a surface potential of the heating roller.

At least one of the cleaning sections other than the cleaning section having the relatively negative potential with respect to the surface potential of the heating roller may be set, at a portion making contact with the heating roller, to have a relatively positive potential with respect to the surface potential of the heating roller.

The heating roller and the pressure roller may be made so that a potential in the vicinity of a surface of the heating roller is set to be relatively negative with respect to a potential in the vicinity of a surface of the pressure roller, at least when the recording medium is interposed between the heating roller and the pressure roller.

At least one of the heating roller and the cleaning sections may have an insulating layer which electrically insulates between the heating roller and the cleaning sections.

Two of the cleaning sections may gradually take up a series of rolled long cloth member on another roller, and individually pressed onto the peripheral surface of the heating roller by a pressure member at two portions positioned on a way of the cloth member being taken up by the another roller, and the cloth member may be pressed, on its different surfaces at the two portions, onto the peripheral surface of the heating roller.

According to another aspect of the present invention, a fixing device for heating and pressing a recording medium carrying an unfixed toner image or an unfixed ink image to fix the unfixed toner image or the unfixed ink image on the recording medium, includes a heating roller which has a heating source and has an endless peripheral surface moves around an axis, a pressure roller which is pressed onto the peripheral surface of the heating roller, and presses the recording medium passing between the pressure roller and the heating roller onto the peripheral surface of the heating roller, and a pressure roller cleaning section which is disposed to face the pressure roller. A potential of the pressure roller cleaning section is set to be relatively negative with respect to a surface potential of the pressure roller.

The heating roller and the pressure roller may be made so that a potential in the vicinity of a surface of the heating roller is set to be one of a same potential with respect to a potential in the vicinity of a surface of the pressure roller and a relatively negative potential with respect to a potential in the vicinity of a surface of the pressure roller, at least when the recording medium is interposed between the heating roller and the pressure roller.

The heating roller and the pressure roller may be made so that a potential of the heating roller is set to be relatively positive with respect to the surface potential of the pressure roller, when the heating roller and the pressure roller make contact with each other, and the fixing device further includes a switch section which switches the potential of the heating roller or the potential of the pressure roller when the recording medium is interposed between the heating roller and the pressure roller or not.

At least one of the pressure roller and the pressure roller cleaning section may have an insulating layer which electrically insulates between the pressure roller and the pressure roller cleaning section.

At least one of the heating roller and the pressure roller may have an insulating layer which electrically insulates between the heating roller and the pressure roller.

According to still another aspect of the present invention, a fixing device for fixing an unfixed toner image or an unfixed ink image on a recording medium, includes a fixing section including a pair of rollers, and plural cleaning sections provided to make contact with one of the pair of rollers of the fixing section. At least one of the cleaning sections is set, at a portion making contact with the one roller, to have a relatively negative potential with respect to a surface potential of the roller.

At least one of the cleaning sections other than the cleaning section having the relatively negative potential with respect to the surface potential of the one roller may be set, at a portion making contact with the roller, to have a relatively positive potential with respect to the surface potential of the roller.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents,

What is claimed is:

1. A fixing device for heating and pressing a recording medium carrying an unfixed toner image or an unfixed ink image to fix the unfixed toner image or the unfixed ink image on the recording medium, comprising:

a heating roller which has a heating source and has an endless peripheral surface moves around an axis;

a pressure roller which is pressed onto the peripheral surface of the heating roller, and presses the recording medium passing between the pressure roller and the heating roller onto the peripheral surface of the heating roller; and a plurality of cleaning sections which are provided to make contact with the heating roller, wherein at least one of the cleaning sections is set, at a portion making contact with the heating roller, to have a relatively negative potential with respect to a surface potential of the heating roller, wherein at least one of the cleaning sections other than the cleaning section having the relatively negative potential with respect to the surface potential of the heating roller is set, at a portion making contact with the heating roller, to have a relatively positive potential with respect to the surface potential of the heating roller.

2. The fixing device according to claim 1, wherein the heating roller and the pressure roller are made so that a potential in the vicinity of a surface of the heating roller is set to be relatively negative with respect to a potential in the vicinity of a surface of the pressure roller, at least when the recording medium is interposed between the heating roller and the pressure roller.

3. The fixing device according to claim 1, wherein at least one of the heating roller and the cleaning sections has an insulating layer which electrically insulates between the heating roller and the cleaning sections.

4. The fixing device according to claim 1, wherein two of the cleaning sections gradually take up a series of rolled long cloth member on another roller, and are individually pressed onto the peripheral surface of the heating roller by a pressure member at two portions positioned on a way of the cloth member being taken up by the another roller, and the cloth member is pressed, on its different, surfaces at the two portions, onto the peripheral surface of the heating roller.

5. A fixing device for heating and pressing a recording medium carrying an unfixed toner image or an unfixed ink image to fix the unfixed toner image or the unfixed ink image on the recording medium, comprising:

a heating roller which has a heating source and has an endless peripheral surface moves around an axis;

a pressure roller which is pressed onto the peripheral surface of the heating roller, and presses the recording medium passing between the pressure roller and the heating roller onto the peripheral surface of the heating roller;

and a pressure roller cleaning section which is disposed to face the pressure roller, wherein a potential of the pressure roller cleaning section is set to be relatively negative with respect to a surface potential of the pressure roller, wherein the heating roller and the pressure roller are made so that a potential in the vicinity of a surface of the heating roller is set to be one of a same potential with respect to a potential in the vicinity of a surface of the pressure roller and a relatively negative potential with respect to a potential in the vicinity of a surface of the pressure roller when the recording medium is interposed between the heating roller and the pressure roller, and a potential of the heating roller is set to be relatively positive with respect to the surface potential of the pressure roller when the heating roller and the pressure roller make contact with each other, and the fixing device further comprises a switch section which changes the potential of the heating roller or the potential of the pressure roller depending on whether the recording medium is interposed between the heating roller and the pressure roller.

6. The fixing device according to claim 5, wherein at least one of the pressure roller and the pressure roller cleaning section has an insulating layer which electrically insulates between the pressure roller and the pressure roller cleaning section.

7. The fixing device according to claim 5, wherein at least one of the heating roller and the pressure roller has an insulating layer which electrically insulates between the heating roller and the pressure roller.

8. A fixing device for fixing an unfixed toner image or an unfixed ink image on a recording medium, comprising:

a fixing section including a pair of rollers; and a plurality of cleaning sections provided to make contact with one of the pair of rollers of the fixing section, wherein at least one of the cleaning sections is set, at a portion making contact with the one roller, to have a relatively negative potential with respect to a surface potential of the roller, wherein at least one of the cleaning sections other than the cleaning section having the relatively negative potential with respect to the surface potential of the one roller is set, at a portion making contact with the roller, to have a relatively positive potential with respect to the surface potential of the roller.

* * * * *